US010995762B2

(12) United States Patent
Gallinelli et al.

(10) Patent No.: US 10,995,762 B2
(45) Date of Patent: May 4, 2021

(54) COMPRESSOR SYSTEM WITH A COOLING ARRANGEMENT BETWEEN THE ANTI-SURGE VALVE AND THE COMPRESSOR SUCTION SIDE AND RELEVANT METHOD

(71) Applicant: Nuovo Pignone Tecnologie Srl, Florence (IT)

(72) Inventors: Lorenzo Gallinelli, Florence (IT); Marco Pelella, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 358 days.

(21) Appl. No.: 15/742,961

(22) PCT Filed: Jul. 7, 2016

(86) PCT No.: PCT/EP2016/066096
§ 371 (c)(1),
(2) Date: Jan. 9, 2018

(87) PCT Pub. No.: WO2017/005842
PCT Pub. Date: Jan. 12, 2017

(65) Prior Publication Data
US 2018/0223856 A1 Aug. 9, 2018

(30) Foreign Application Priority Data
Jul. 9, 2015 (IT) ..... 102015000032409

(51) Int. Cl.
*F04D 27/02* (2006.01)
*F04D 29/58* (2006.01)
(Continued)

(52) U.S. Cl.
CPC ..... *F04D 27/0223* (2013.01); *F04D 17/10* (2013.01); *F04D 17/12* (2013.01);
(Continued)

(58) Field of Classification Search
CPC ..... F04D 17/10; F04D 17/12; F04D 27/00; F04D 27/009; F04D 27/02;
(Continued)

(56) References Cited

U.S. PATENT DOCUMENTS 3,527,059 A * 9/1970 Rust ..... F25J 1/0052 62/115
5,306,116 A * 4/1994 Gunn ..... F04D 27/02 415/17
(Continued)

FOREIGN PATENT DOCUMENTS

EP 2 426 361 A2 3/2012
WO 2005/010375 A1 2/2005
(Continued)

OTHER PUBLICATIONS

Gallinelli, L., et al., Compressor system with a gas temperature control at the inlet of the anti-surge line and relevant method, GE Co-pending Application No. 102015000032392, filed on Jul. 9, 2015.
(Continued)

*Primary Examiner* — Len Tran
*Assistant Examiner* — Gustavo A Hincapie Serna
(74) *Attorney, Agent, or Firm* — Baker Hughes Patent Organization

(57) ABSTRACT

A compressor system is described, including:
at least a first compressor having a suction side and a delivery side;
an anti-surge line;
an anti-surge valve arranged along the anti-surge line and controlled for recirculating a gas flow from the delivery side back to the suction side of the compressor;
a heat removal arrangement between the anti-surge valve and the suction side of the compressor.

7 Claims, 6 Drawing Sheets

(51) Int. Cl.

| | |
|---|---|
| ***F04D 17/12*** | (2006.01) |
| ***F25J 1/00*** | (2006.01) |
| ***F25J 1/02*** | (2006.01) |
| ***F04D 17/10*** | (2006.01) |

(52) U.S. Cl.
CPC ..... *F04D 27/0207* (2013.01); *F04D 27/0215* (2013.01); *F04D 27/0292* (2013.01); *F04D 29/5826* (2013.01); *F25J 1/0022* (2013.01); *F25J 1/0052* (2013.01); *F25J 1/0055* (2013.01); *F25J 1/0236* (2013.01); *F25J 1/0291* (2013.01); *F25J 1/0298* (2013.01); *F05B 2270/303* (2013.01); *F05D 2270/303* (2013.01); *F25J 2280/02* (2013.01); *F25J 2280/20* (2013.01)

(58) Field of Classification Search
CPC ..... F04D 27/0207; F04D 27/0215; F04D 27/0223; F04D 27/0292; F04D 29/58; F04D 29/5826; F04D 29/5833; F05B 2270/1081; F05B 2270/303; F25J 1/0022; F25J 1/0052; F25J 1/0055; F25J 1/0236; F25J 1/0291; F25J 1/0298; F25J 2280/02; F25J 2280/20
USPC ..... 62/611
See application file for complete search history.

(56) References Cited

U.S. PATENT DOCUMENTS

| | | | | |
|---|---|---|---|---|
| 6,247,316 | B1 * | 6/2001 | Viteri | F01K 21/04 60/716 |
| 6,332,336 | B1 * | 12/2001 | Mirsky | F01D 15/08 62/613 |
| 6,389,844 | B1 * | 5/2002 | Klein Nagel Voort | F25J 1/0214 62/612 |
| 8,676,554 | B2 * | 3/2014 | Ebisawa | F04D 27/001 703/7 |
| 9,726,196 | B2 * | 8/2017 | Gilarranz | F04D 17/12 |
| 10,371,441 | B2 * | 8/2019 | Van Leeuwen | C10G 7/02 |
| 10,473,109 | B2 * | 11/2019 | Gallinelli | F04D 27/0215 |
| 2005/0022552 | A1 * | 2/2005 | Lucas | F25J 1/0283 62/613 |
| 2007/0204649 | A1 * | 9/2007 | Kaart | F25J 1/0087 62/612 |
| 2008/0194869 | A1 * | 8/2008 | Galloway | C07C 51/42 562/532 |
| 2008/0289360 | A1 * | 11/2008 | Kaart | F25J 1/0052 62/611 |
| 2009/0188277 | A1 * | 7/2009 | Chantant | F25B 49/02 62/612 |
| 2011/0277498 | A1 * | 11/2011 | Kaart | F25J 1/0294 62/613 |
| 2013/0312438 | A1 * | 11/2013 | Kudo | F25B 25/005 62/84 |
| 2016/0102671 | A1 * | 4/2016 | Winkes | F04D 29/5826 415/1 |

FOREIGN PATENT DOCUMENTS

| | | | | |
|---|---|---|---|---|
| WO | 2009/050175 | A1 | 4/2009 | |
| WO | WO-2009050175 | A1 * | 4/2009 | F04D 27/0207 |
| WO | 2014/191312 | A1 | 12/2014 | |

OTHER PUBLICATIONS

Italian Search Report and Written Opinion issued in connection with corresponding IT Application No. IT102015000032409 dated Mar. 17, 2016.
International Search Report and Written Opinion issued in connection with corresponding PCT Application No. PCT/EP2016/066096 dated Oct. 4, 2016.
International Preliminary Report on Patentability issued in connection with corresponding PCT Application No. PCT/EP2016/066096 dated Jan. 18, 2018.

* cited by examiner

COMPRESSOR SYSTEM WITH A COOLING ARRANGEMENT BETWEEN THE ANTI-SURGE VALVE AND THE COMPRESSOR SUCTION SIDE AND RELEVANT METHOD

FIELD OF THE INVENTION

The disclosure in general relates to compressor systems for processing a gas. More specifically, embodiments disclosed herein concern compressor systems comprising at least one compressor with an anti-surge arrangement.

BACKGROUND

Compressor systems for compressing a working fluid are commonly used in several industrial processes and plants. Typically, compressor systems are used for instance in plants for the liquefaction of natural gas (shortly LNG plants), where natural gas is compressed and liquefied to reduce the volume thereof, for transportation purposes. One or more refrigeration circuits are used to remove heat from the natural gas. A refrigerant fluid is made to circulate in the refrigeration circuit and is subject to cyclic thermodynamic transformations to remove heat from the natural gas and discharge the removed heat to a heat sink In essence, a refrigeration circuit comprises a high pressure side and a low pressure side. The refrigerant fluid from the low pressure side of the refrigeration circuit is compressed and cooled in a heat exchanger in heat exchange relationship with a heat sink. The compressed and cooled refrigerant fluid is then expanded in an expansion device, such as an expansion valve or an expander and subsequently flows in a heat exchanger in heat exchange relationship with the natural gas, removing heat therefrom, prior to be compressed again.

A compressor system is used to compress the refrigerant fluid. The compressor system usually includes one or more compressors, such as centrifugal compressor(s) and/or axial compressor(s), where through the refrigeration fluid is compressed from the low pressure to the high pressure of the refrigeration cycle. Each compressor is usually comprised of an anti-surge line, connecting the delivery side of the compressor to the suction side thereof. An anti-surge valve arranged along the anti-surge line is selectively opened during start-up of the compressor, or when the operating conditions of the compressor are such that the operating point approaches the surge line. Recirculation of the processed gas prevents surging phenomena, which could otherwise result in serious damages to the compressor.

The anti-surge line has an inlet and an outlet. The inlet is fluidly coupled to the delivery side of the compressor and the outlet is fluidly coupled to the suction side of the compressor. Since the compressed gas delivered by the compressor is at a higher temperature than the low-pressure gas at the suction side of the compressor, the inlet of the anti-surge line is arranged downstream of a gas cooler, such that cooled gas enters the anti-surge line. This prevents overheating of the compressor during transient operating conditions, when the anti-surge valve is open.

If the working gas processed by the compressor, for instance a refrigeration gas for LNG, contains components of different molecular weights, the heavier components may condense in the gas cooler downstream the compressor and produce a liquid phase in the gas flow. In this case, if the anti-surge valve is opened, the fluid which circulates in the anti-surge line and through the anti-surge valve contains a percentage of liquid. Depending upon the operating conditions and the position of the compressor in the refrigeration cycle, the percentage of condensed gas can be relatively high, e.g. above 30% by weight or even equal to or higher than 40% by weight.

Typically, LNG plants using a so-called mixed refrigerant are subject to gas condensation in the gas cooler arranged upstream of the inlet of the anti-surge line. Mixed refrigerant can usually contain a mixture of propane, ethane, methane and possibly other components, such as nitrogen, isobutene, n-butane and the like. Especially the heavier components (propane and ethane) can condense in the gas cooler giving rise to a high amount of condensed gas in the refrigerant flow. The anti-surge valve can be damaged by the liquid flowing therethrough.

Similar issues may arise in any compression facility comprised of a compressor system with a compressor and an anti-surge line and anti-surge valve arrangement, whenever the temperature of the gas flowing through the gas cooler downstream of the compressor can drop below the dew point, i.e. the point where the heavier components of the gas start condensing.

A need therefore exists, to improve compressor systems, in order to prevent or alleviate the above mentioned drawbacks.

SUMMARY OF THE INVENTION

According to embodiments disclosed herein, a compressor system is provided, comprising at least a first compressor having a suction side and a delivery side and an anti-surge line in parallel to the compressor. An anti-surge valve is arranged along the anti-surge line and is controlled for recirculating a gas flow from the delivery side to the suction side of the compressor. A heat removal arrangement is arranged between the anti-surge valve and the suction side of the compressor.

The gas entering the anti-surge valve can thus be at the same temperature as the gas at the delivery side of the compressor, or else at a temperature lower than the delivery temperature of the compressor, but in an embodiment above a dew point temperature, i.e. above the temperature at which liquid phase starts separating from the gas. No liquid phase or a reduced amount of liquid phase thus flows through the anti-surge valve. By removing heat through the heat removal arrangement downstream of the anti-surge valve, and upstream of the suction side of the compressor, overheating of the compressor is prevented, when the compressor operates with the anti-surge valve in open or partly open.

According to some embodiments, the heat removal arrangement comprises a quench valve, which is fluidly coupled to a reservoir, i.e. a tank or container, containing a condensed gas separated from the gas processed by the first compressor and at a pressure higher than a gas pressure at the suction side of the first compressor. The quench valve can further be fluidly coupled between the anti-surge valve and the suction side of the first compressor. The quench valve is arranged and controlled for spraying a flow of said condensed gas in a gas stream flowing through the anti-surge line.

According to further embodiments, the compressor system can comprise at least a first gas cooler arranged downstream of the delivery side of the first compressor and fluidly coupled thereto.

In addition to or as an alternative to the quench valve, the heat removal arrangement can comprise an anti-surge cooler comprised of at least one heat exchanger arranged between the anti-surge valve and the suction side of the compressor, and in heat exchange relationship with a cooling medium; the anti-surge cooler being configured and arranged to remove heat from gas flowing from the anti-surge line in the first compressor. The cooling medium can be condensed gas processed by said first compressor. In other embodiments, the cooling medium can be air, water or another cooling medium.

The present disclosure also concerns a natural gas liquefaction plant, comprising a natural gas duct in heat exchange relationship with a refrigerant circuit, arranged and configured for removing heat form natural gas flowing in the natural gas duct; wherein the refrigerant circuit comprises a compressor system as disclosed herein.

According to a further aspect, disclosed herein is a method for processing a gas in a compressor system. The compressor system comprises at least a compressor having a suction side and a delivery side, an anti-surge line, an anti-surge valve arranged along the anti-surge line and controlled for recirculating a gas flow from the delivery side to the suction side of the compressor. According to embodiments disclosed herein the method comprises the following steps: processing a gas through the compressor; when gas is required to recirculate through the anti-surge line, opening the anti-surge valve causing gas to recirculate from the delivery side of the compressor to the suction side of the compressor through the anti-surge valve and the anti-surge line; removing heat from the recirculating gas, between the anti-surge valve and the suction side of the compressor.

Other features and advantages of the invention will be better appreciated from the following detailed description of exemplary embodiments.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION

Figure 1:
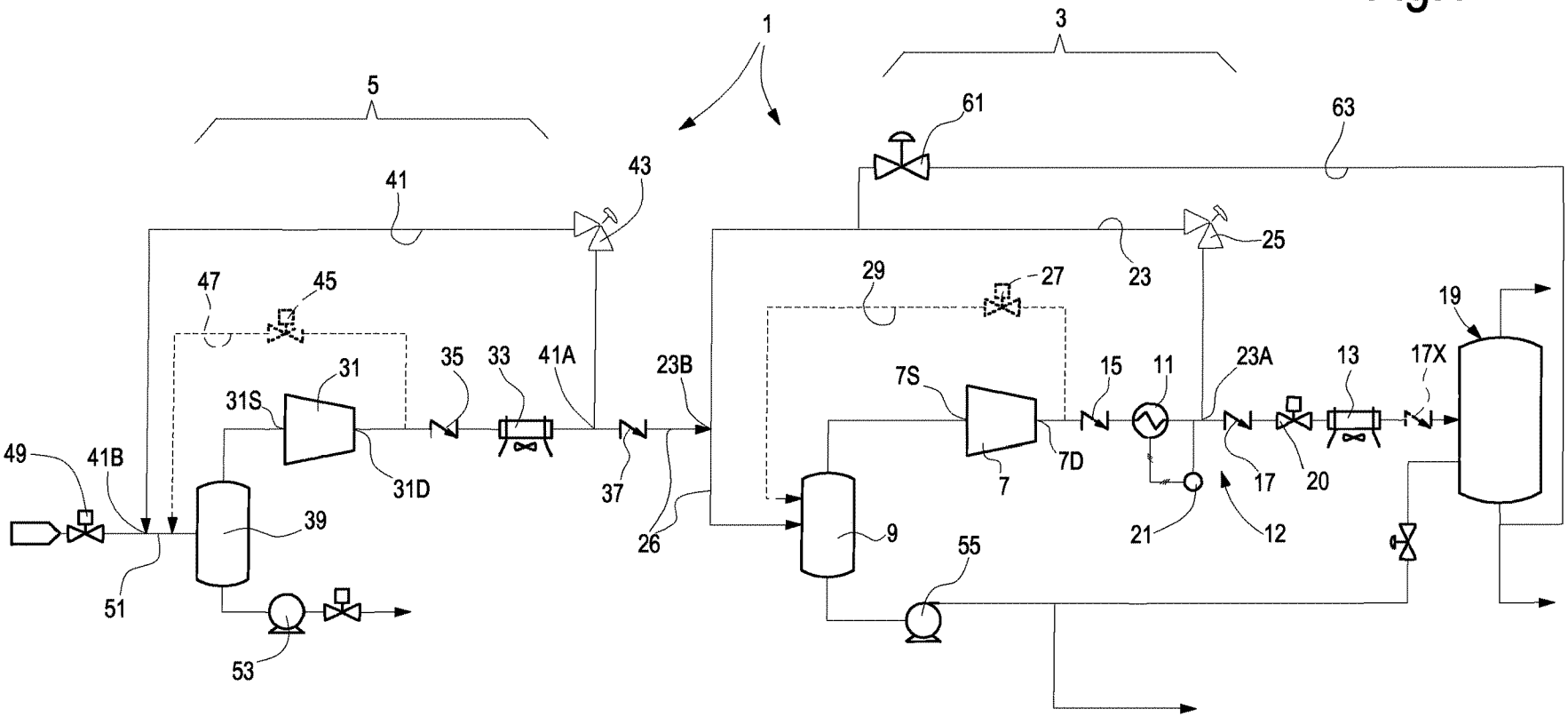
FIG. 1 illustrates a schematic of a compressor system according to an embodiment.

As will be described in more detail herein after, according to embodiments of the subject matter disclosed herein, in order to prevent overheating of the compressor when the anti-surge valve is open, and at the same time in order to prevent or at least reduce damages of the anti-surge valve due to possible presence of liquid in the gas flow returned from the compressor delivery side to the compressor suction side, according to embodiments disclosed herein, the gas returned through the anti-surge line is cooled downstream of the anti-surge valve, prior to being sucked again in the compressor. The gas flow from the delivery side of the compressor can be de-superheated in a first gas cooler, upstream of the inlet of the anti-surge line, maintaining however the gas temperature above the dew point, i.e. above the temperature value at which the heavier gas components start condensing. Liquid formed by condensation of heavier gas components can thus be present downstream of the anti-surge valve (with respect to the gas flow in the anti-surge line), since this does not damage the anti-surge valve, while the gas flow upstream of the anti-surge valve can be substantially free of a liquid phase.

In the description and in the appended claims, unless differently specified, the terms "upstream" and "downstream" are referred to the direction of the gas flow.

According to some embodiments, the gas flowing through the anti-surge valve does not require to be entirely dry. A certain percentage of liquid phase can be tolerated by the anti-surge valve. If needed, liquid-tolerant anti-surge valves can be employed, in particular if the presence of some percentage of liquid phase in the flow through the anti-surge valve cannot be avoided, or if a risk exist that under certain operating conditions such liquid phase can be present.

In general, the percentage of liquid phase in the anti-surge line upstream of the anti-surge valve depends substantially upon the compressor efficiency, the composition of the processed gas and temperature of the gas at the gas cooler outlet.

In some embodiments, an enhanced effect is obtained by providing a partial cooling of the gas prior to the ingress in the anti-surge line, followed by additional cooling in the anti-surge line, between the anti-surge valve and the outlet of the anti-surge line, i.e. downstream of the anti-surge valve, with respect to the direction of the gas flow.

As will become apparent from the following description of exemplary embodiments, cooling of the gas can be obtained by means of heat exchange in a heat exchanger or a cooler, where the gas flows in a heat exchange relationship with a cooling medium, the cooling medium and the gas being separated from one another. In other embodiments, cooling is obtained by means of latent heat of vaporization absorbed by a liquid sprayed, e.g. by a quench valve, in the main gas flow, circulating in the anti-surge line. In some embodiments, both cooling processes can be used in combination.

Referring now to FIG. 1, in a first embodiment a compressor system 1 comprises a first section 3 and a second section 5, the second section 5 being arranged upstream of the first section 3 with respect to the gas flow through the compressor system 1.

The first section 3 comprises a first compressor 7 having a suction side 7S and a delivery side 7D. The first compressor 7 can be for instance an axial compressor or a centrifugal compressor.

Gas processed by the first compressor 7 enters the compressor at the suction side 7S at a suction pressure and is delivered at a delivery pressure, at the delivery side 7D, the delivery pressure being higher than the suction pressure. The suction side 7S of the first compressor 7 can be in fluid communication with a suction drum 9. The suction drum 9 is a liquid/gas separator that separates a liquid phase (e.g. condensed gas) possibly present in the gas flow, from the gaseous phase which is sucked through the suction side 7S, such that the gas entering the first compressor 7 is substantially free of liquid.

Downstream of the delivery side 7D of the first compressor 7 a first gas cooler 11 and a second gas cooler 13 are sequentially arranged. The first gas cooler 11 is fluidly coupled to the delivery side 7D of the first compressor 7 and receives a flow of compressed gas therefrom. The partly cooled gas flow exiting the first gas cooler 11 flows through the second gas cooler 13.

The first gas cooler 11 and the second gas cooler 13 are part of a gas temperature manipulation arrangement 12, which is arranged and configured to prevent or reduce a liquid phase to be present in an anti-surge line arranged in parallel to the first compressor 7, as will be described herein after.

According to some arrangements, a check valve 15 can be arranged between the delivery side 7D of the first compressor 7 and the inlet of the first gas cooler 11. A discharge check valve 17 can be arranged between the first gas cooler 11 and the second gas cooler 13. Alternatively or in addition to the discharge check valve 17, a discharge check valve 17X can be arranged downstream of the second gas cooler 13.

In the context of the present description and attached claims, the first gas cooler 11 and the second gas cooler 13 can be formed by two sections of a single gas cooler arrangement, having two or more sections. In some embodiments, one section of the gas cooler arrangement operates as a de-superheater and a subsequent downstream section operates as a condenser or partial condenser, i.e. the gas flowing therethrough is at least partly condensed by heat exchange with a cooling medium, such as air or water.

When different sections of a gas cooler arrangement embody the first gas cooler 11 and second gas cooler 13, the inlet of the anti-surge line 23 is connected between the two sections of the gas cooler arrangement.

Downstream of the second gas cooler 13 a liquid/gas separator 19 is arranged, wherein condensed gas is separated from the gaseous phase of the compressed and cooled gas flow exiting the second gas cooler 13.

The first gas cooler 11 can include a gas/water heat exchanger, a gas/air heat exchanger, or a combination thereof, or any other heat exchanger, depending upon the heat sink available and the ambient conditions at the location where the compressor system 1 is installed and/or upon the operating conditions of the compressor system 1. Similarly, the second gas cooler 13 can include a gas/water heat exchanger, a gas/air heat exchanger, or a combination thereof, or any other heat exchanger, depending upon the heat sink available at the location where the compressor system 1 is installed and/or upon the operating conditions thereof. The first gas cooler 11 and the second gas cooler 13 can use the same cooling fluid, e.g. air or water, or different cooling fluids, for instance one can use water and the other can use air.

According to some embodiments, a shut-down valve 20 can be arranged between the first gas cooler 11 and the second gas cooler 13.

The first gas cooler 11 can be provided with a temperature controller 21. The temperature controller 21 can be functionally connected to a temperature sensor (not shown) arranged for detecting the temperature of the gas flow at the outlet of the first gas cooler 11. The temperature controller 21 can have a temperature set point which is slightly above the dew point of the gas flowing through the compressor system 1. For instance the temperature set point Ts of the temperature controller 21 can be set as follows:

$$Ts=Td+Tm$$

where; Ts is the set-point temperature of controller 21; Td is the dew point; Tm is a temperature safety margin.

The temperature controller 21 forms part of the gas temperature manipulation device and can control for instance an air fan arrangement or a cooling water pump arrangement such that gas temperature at the outlet of the first gas cooler 11 is maintained around the temperature set point Ts.

A first anti-surge line 23 is arranged in parallel to the first compressor 7. The first anti-surge line 23 has an inlet 23A and an outlet 23B. The inlet 23A of the first anti-surge line 23 is arranged between the first gas cooler 11 and the second gas cooler 13, while the outlet 23B of first anti-surge line 23 is fluidly coupled to the suction side 7S of the first compressor 7. In the arrangement shown in FIG. 1, the outlet 23B of the anti-surge line 23 is fluidly coupled to the suction side 7S of the first compressor 7 through a gas feeding line 26 which is in turn in fluid communication with the first suction drum or liquid/gas separator 9.

A first anti-surge valve 25 is arranged along the first anti-surge line 23. The first anti-surge valve 25 is controlled in a manner known to those skilled in the art, in order to partly or totally open during certain operative transient conditions of the first compressor 7. For instance, the first anti-surge valve 25 is open at start-up of the first compressor 7. The first anti-surge valve 25 is further opened if the operating point of the compressor 7 approaches the so-called surge-control line, to prevent damages to the compressor.

A hot gas by-pass valve 27 and a respective hot gas by-pass line 29 can also be provided, if needed, to establish a further connection between the delivery side 7D and the suction side 7S of the first compressor 7.

The compressor system 1 of FIG. 1 further comprises a quench valve 61 provided along a quench line 63. The quench valve 61 can be part of the gas temperature manipulation arrangement 12.

Figure 2:
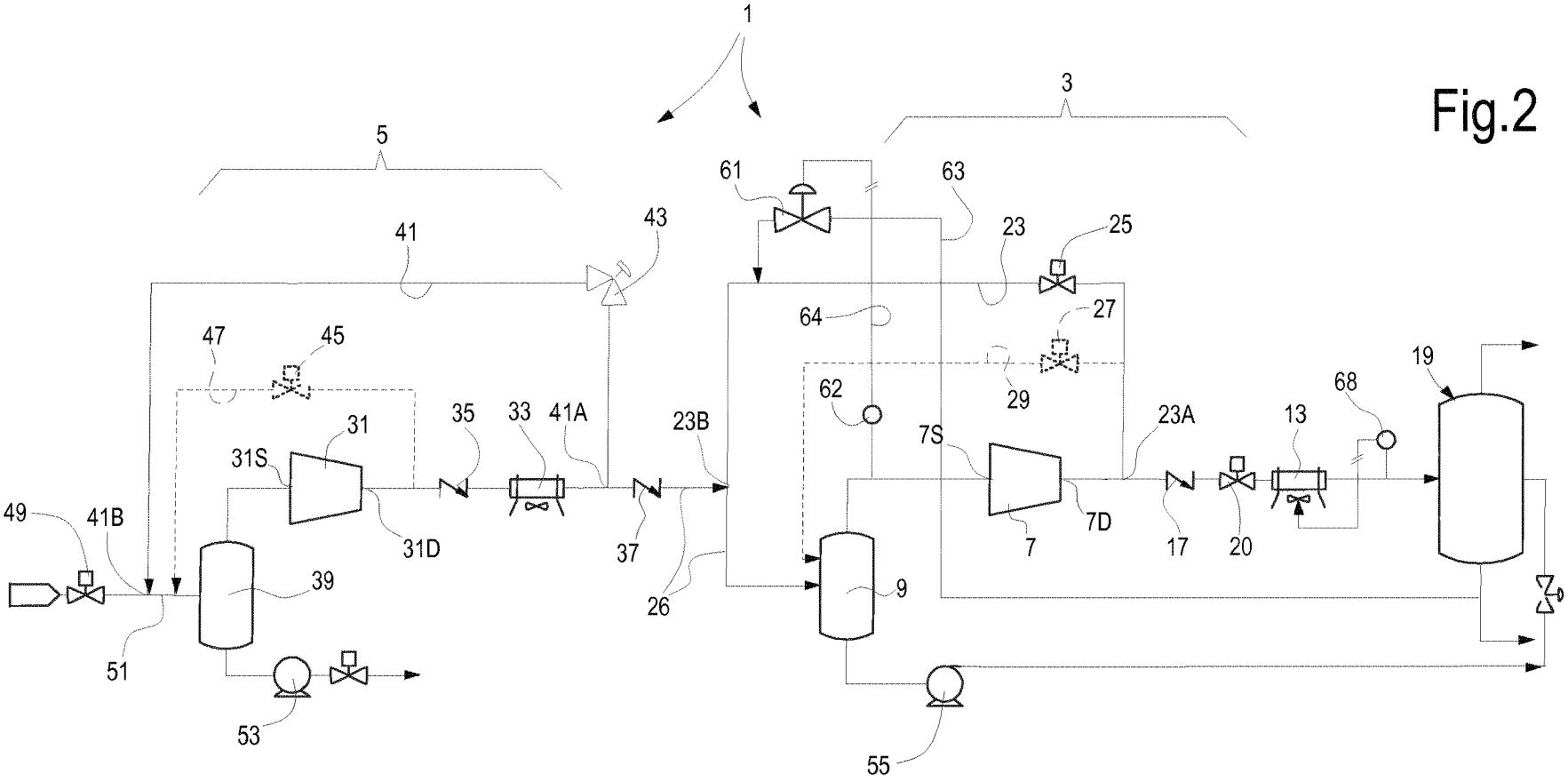
FIG. 2 illustrates a schematic of a compressor system according to an embodiment.

The inlet of the quench line 63 is fluidly coupled to a source of condensed gas. The outlet of the quench line 63 is fluidly coupled to the first anti-surge line 23. More specifically, the source of condensed gas can be the liquid/gas separator 19, as schematically shown in FIG. 2. In other embodiments, a different condensed gas source can be provided, for instance a condensed gas tank, where condensed gas is present.

A pressure drop is provided across the quench valve 61, such that when the quench valve 61 is open, a flow of condensed gas from the condensed gas source is sprayed in the first anti-surge line 23, between the first anti-surge valve 25 and the outlet 23B of the first anti-surge line 23, i.e. downstream of the first anti-surge valve 25 with respect to the direction of gas flow along the first anti-surge line 23.

During transient operation of the compressor system 1, when the first anti-surge valve 25 opens and causes compressed and cooled gas from first gas cooler 11 to recirculate towards the suction side 7S of the first compressor 7, a flow of condensed gas can be sprayed through the quench valve 61 in the first anti-surge line 23. The sprayed condensed gas mixes with the flow of compressed gas from the first anti-surge valve 25, which has been partly cooled in the first gas cooler 11. The higher temperature of the recirculated gas from the first anti-surge valve 25 causes abrupt evaporation of the condensed gas, sprayed by the quench valve 61. The condensed gas evaporates absorbing latent heat, such that the total gas flow, i.e. the gas flowing through the first anti-surge valve 25 and evaporated gas from the quench valve 61, has a temperature lower than the temperature at the outlet of the first gas cooler 11. An enhanced cooling of the gas returning towards the suction side 7S of the first compressor 7 is thus obtained, which more effectively prevent overheating of the first compressor 7, also in case the first anti-surge valve 25 remains open for a long time period.

Possible condensed gas present in the flow returning towards the suction side 7S of the first compressor 7 can be separated from the gas flow in the first suction drum or liquid/gas separator 9.

In some embodiments, the quench valve 61 can be used only during start-up of the compressor system 1. During start-up the first gas cooler 11 is sufficient to chill the gas from the first compressor 7 and re-cycled through the anti-surge line 23. The quench valve 61 can be controlled by a temperature controller, based on a temperature at the suction side 7S of the compressor 7. The quench valve 61 will thus be usually closed during steady-state operation of the compressor system 1, to prevent too low a gas temperature at the suction side 7S of the first compressor 7.

As mentioned above, in the embodiment of FIG. 1 the compressor system 1 comprises a second section 5, upstream of the first section 3 with respect to the general gas flow direction. The second section 5 comprises a second compressor 31 with a suction side 31S and a delivery side 31D. A third gas cooler 33 can be arranged downstream of the delivery side 31D of the second compressor 31 along a gas feeding line 26 which connects the delivery side 31D of the second compressor 31 to the suction side 7S of the first compressor 7, and more specifically connecting the delivery side 31D of the second compressor 31 to the liquid/gas separator or suction drum 9. A check valve 35 can be arranged along the gas feeding line 26, between the delivery side 31D of compressor 31 and the third gas cooler 33. Furthermore, a discharge check valve 37 can be arranged downstream of the third gas cooler 33.

The third gas cooler 33 is in fluid communication with the first suction drum 9 through the discharge valve 37. A second suction drum 39 can be provided upstream of the suction side 31S of the second compressor 31. The second suction drum 39 operates as a liquid/gas separator for separating liquid, e.g. condensed gas, from the gaseous stream delivered to the suction side 31S of the second compressor 31.

A second anti-surge line 41, comprised of a second anti-surge valve 43, is connected between the outlet of the third gas cooler 33 and the inlet of the second suction drum 39. Reference numbers 41A and 41B designate the inlet and the outlet of the anti-surge line 41, respectively. A hot gas by-pass valve 45 on a hot gas by-pass line 47 can also be provided in parallel to the second compressor 31.

A shut down valve 49 can further be arranged upstream of the second suction drum 39, along a gas feeding duct 51.

The operation of the compressor system 1 is as follows. Gas is fed through feeding duct 51 and through the second suction drum 39 to the suction side 31S of the second compressor 31. As mentioned, the gas can comprise a mixture of different gaseous components, e.g. propane, ethane, methane, nitrogen and the like. Liquid possibly present in the incoming gas flow can be separated in the second suction drum 39 and delivered to the liquid/gas separator 19. A pump 53 can pump the liquid from the low pressure inside the second suction drum 39 to the high pressure in the liquid/gas separator 19.

The gas is compressed by the second compressor 31 and cooled in the third gas cooler 33 and subsequently fed to the first section 3 of the compressor system 1 through the first suction drum 9. Liquid present in the gas flow can be separated in the first suction drum 9 and delivered to the liquid/gas separator 19, for instance. A pump 55 can be used to boost the liquid pressure from the pressure inside the first suction drum 9 to the high pressure inside the liquid/gas separator 19 or other liquid tank. In other embodiments, not shown, the condensed gas separated in the suction drum 9 can be delivered to a condensed gas tank or a suction drum at a pressure lower than the pressure in suction drum 9, such that no pump is required.

Gas is further compressed in the first compressor 7 and delivered at the delivery side 7D thereof through the first gas cooler 11 and the second gas cooler 13 and finally to the liquid/gas separator 19.

In some operating conditions, part or all the gas flow can be diverted through the second anti-surge line 41 by opening the second anti-surge valve 43. The gas recirculating through the second anti-surge line 41 has been previously cooled in the third cooler 33. The operating conditions of the compressor system 1 can be such that the amount of liquid phase (i.e. condensed gas) present at the outlet of third gas cooler 33 is sufficiently small, such that the second anti-surge valve 43 is not damaged by the liquid flowing therethrough. Alternatively, a liquid-tolerant second anti-surge valve 43 can be employed.

In some operating conditions, part or all the gas flow can be diverted through the first anti-surge valve 25 and the first anti-surge line 23. Since cooling of the compressed gas exiting the first compressor 7 is performed in two steps through the first gas cooler 11 and the second gas cooler 13, the gas entering the first anti-surge line 23 is substantially free of condensed gas, or contains a limited amount of liquid phase, as mentioned above. Damages to the first anti-surge valve 25 are prevented or at least substantially reduced. A liquid-tolerant anti-surge valve 25, i.e. a valve capable of withstanding a bi-phase flow, can be employed if desired. At the same time, the gas circulating in the first anti-surge line 23 is sufficiently cold, to prevent overheating of the first compressor 7.

Since the temperature of the gas entering the anti-surge line 23 is relatively high, due to the need of avoiding gas liquefaction in the first gas cooler 11, additional gas cooling can be obtained by spraying condensed gas through the quench valve 61 in the main flow of gas through the anti-surge line 23, downstream of the anti-surge valve 25. The sprayed condensed gas evaporates absorbing latent evaporation heat, thus further reducing the temperature of the gas returned to the suction side 7S of the first compressor 7.

Depending upon the operating conditions of the compressor system 1, the quench valve 61 may remain inoperative, in which case cooling of the gas recirculating through the anti-surge line 23 will be provided by the first gas cooler 11 only. In other operating conditions the first gas cooler 11 can remain inoperative, in which case cooling of the gas recirculating through the anti-surge line 23 will be obtained by the quench valve 61 only. In other operating conditions, e.g. at start-up, the first gas cooler 11 is in operation in combination with the quench valve 61.

According to some embodiments, not shown, a similar quench valve can be provided also in the second section 5.

FIG. 2 illustrates a further embodiment of a compressor system 1 according to the present disclosure. The same reference numbers designate the same or corresponding parts, elements or components as shown in FIG. 1. These latter will not be described again in detail.

The second section 5 of the compressor system 1 of FIG. 2 is substantially identical to the section 5 of compressor system 1 of FIG. 1. Conversely, the first section 3 includes only one gas cooler 13 downstream of the first compressor 7. The inlet of the anti-surge line 23 is fluidly coupled to the delivery side 7D of the first compressor 7. Cooling of the gas recirculating in the anti-surge line 23 is obtained by means of the quench valve 61 provided along the quench line 63.

Condensed gas is sprayed by the quench valve 61 in the anti-surge line 23 and is subject to sudden evaporation by means of heat absorbed from the hot gas delivered by the first compressor 7 at the delivery side 7D and flowing in the anti-surge line 23. The condensed gas can be provided by the liquid/gas separator 19 and/or by the liquid/gas separator 9, both of which can be fluidly coupled with the quench line 63. The pump 55 boosts the pressure of the condensed gas from liquid/gas separator 9 up to the required pressure. In other embodiments, the condensed gas can be delivered to a tank at a pressure which is equal to or lower than the pressure in the liquid/gas separator 9. In this case the pump 55 can be dispensed with.

The quench valve 61 can be controlled by a temperature controller 62, which can be functionally connected to a temperature sensor, not shown. The latter can be arranged and configured to detect the temperature of the gas at the suction side 7S of the first compressor 7. During transient operation, when the anti-surge valve 25 is open, if the temperature of the gas at the suction side 7S of compressor 7 is higher than a set-point, the quench valve 61 can be opened, thus obtaining cooling of the gas flowing through the anti-surge line 23, thanks to latent vaporization heat absorbed by the sprayed condensed gas, which is delivered through the quench valve 61.

In some embodiments, a further temperature controller 68 can be provided, for controlling the operation of the gas cooler 13. The temperature controller 68 can be functionally coupled to a temperature sensor, not shown, arranged downstream of the gas cooler 13, such that a greater or smaller amount of heat can be removed by the gas cooler 13, in order to maintain the desired temperature set-point at the inlet of the liquid/gas separator 19, for instance.

Figure 3:
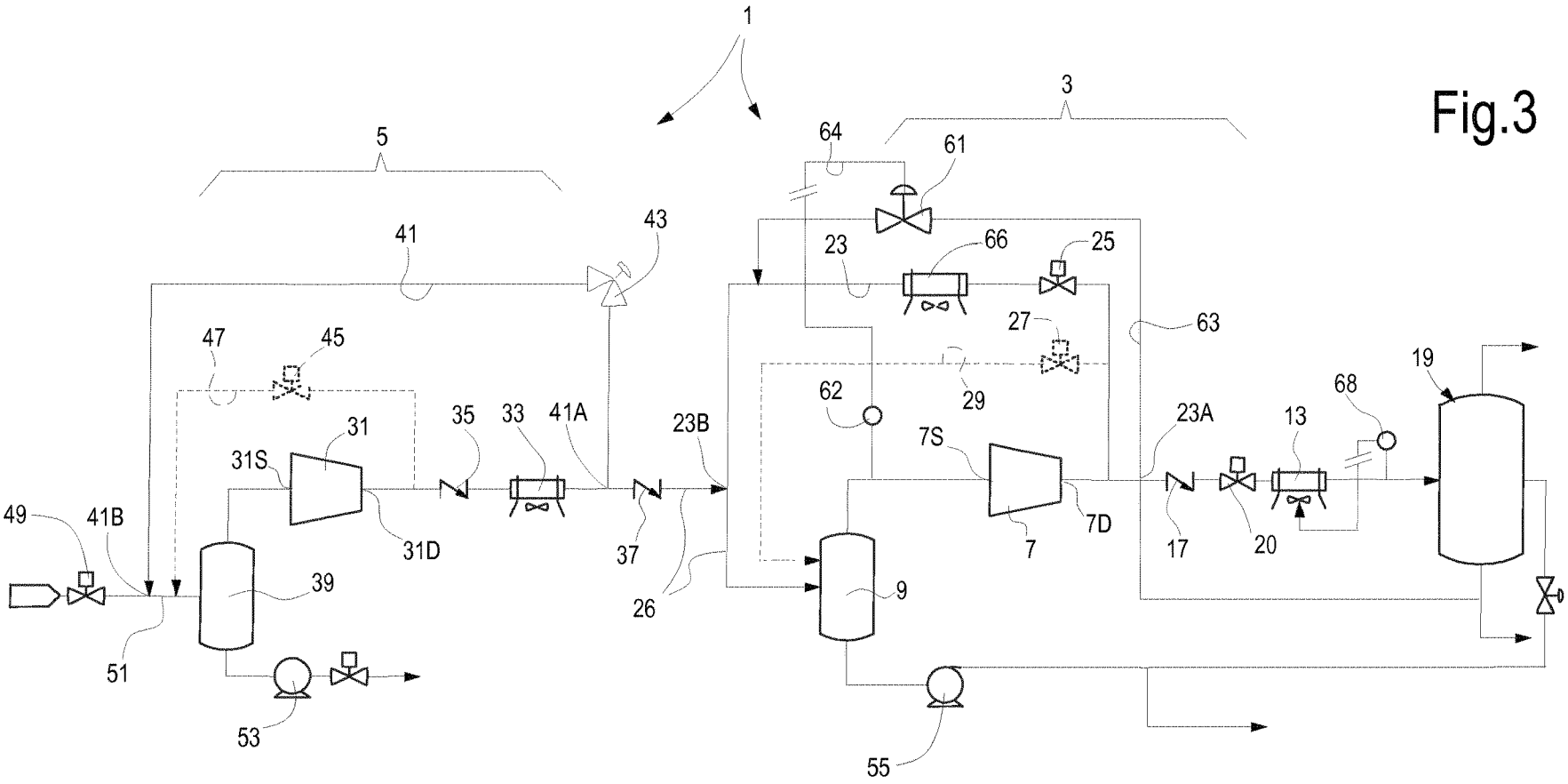
FIG. 3 illustrates a schematic of a compressor system according to an embodiment.

FIG. 3 illustrates a further embodiment of a compressor system 1. Parts, components and elements corresponding to those already described in connection with FIGS. 1 and 2 are indicated with the same reference numbers and will not be described again.

The second section 5 of the compressor system 1 of FIG. 3 is substantially identical to the section 5 of FIGS. 1 and 2. Conversely, the first section 3 comprises an additional anti-surge cooler along the anti-surge line 23, downstream of the anti-surge valve 25, i.e. between this latter and the outlet 23B of the anti-surge line 23. The anti-surge cooler can be comprised of a heat exchanger 66. Gas recirculating through the anti-surge line 23 and the heat exchanger 66 exchanges heat against a cooling medium which circulates in the cold side of the heat exchanger 66. The cooling medium can be cooling air or cooling water or any other suitable cooling fluid. In some embodiments, the cooling medium can be condensed gas, dispensed by a condensed gas container, such as the liquid/gas separator 19 or the liquid/gas separator 9.

In the embodiment of FIG. 3 the gas recirculating in the anti-surge line 23 is thus subjected to a double cooling effect: one cooling effect is obtained by removal of heat by heat exchange against a cooling medium in heat exchanger 66. Further cooling is by way of latent vaporization heat removed by the condensed gas sprayed in the anti-surge line 23 through quench valve 61. Under steady state conditions, the quench valve 61 can be inoperative. If the heat exchanger 66 is not sufficient to chill the recirculating gas, the quench valve 61 can be opened by the quench valve controller.

A temperature controller 62 can be provided to control the quench valve 61. In addition or in alternative to the temperature controller 62, in other embodiments (not shown) a temperature controller can be associated to the heat exchanger 66. The control temperature can again be the temperature of the gas at the suction side 7S of the first compressor 7.

Figure 4:
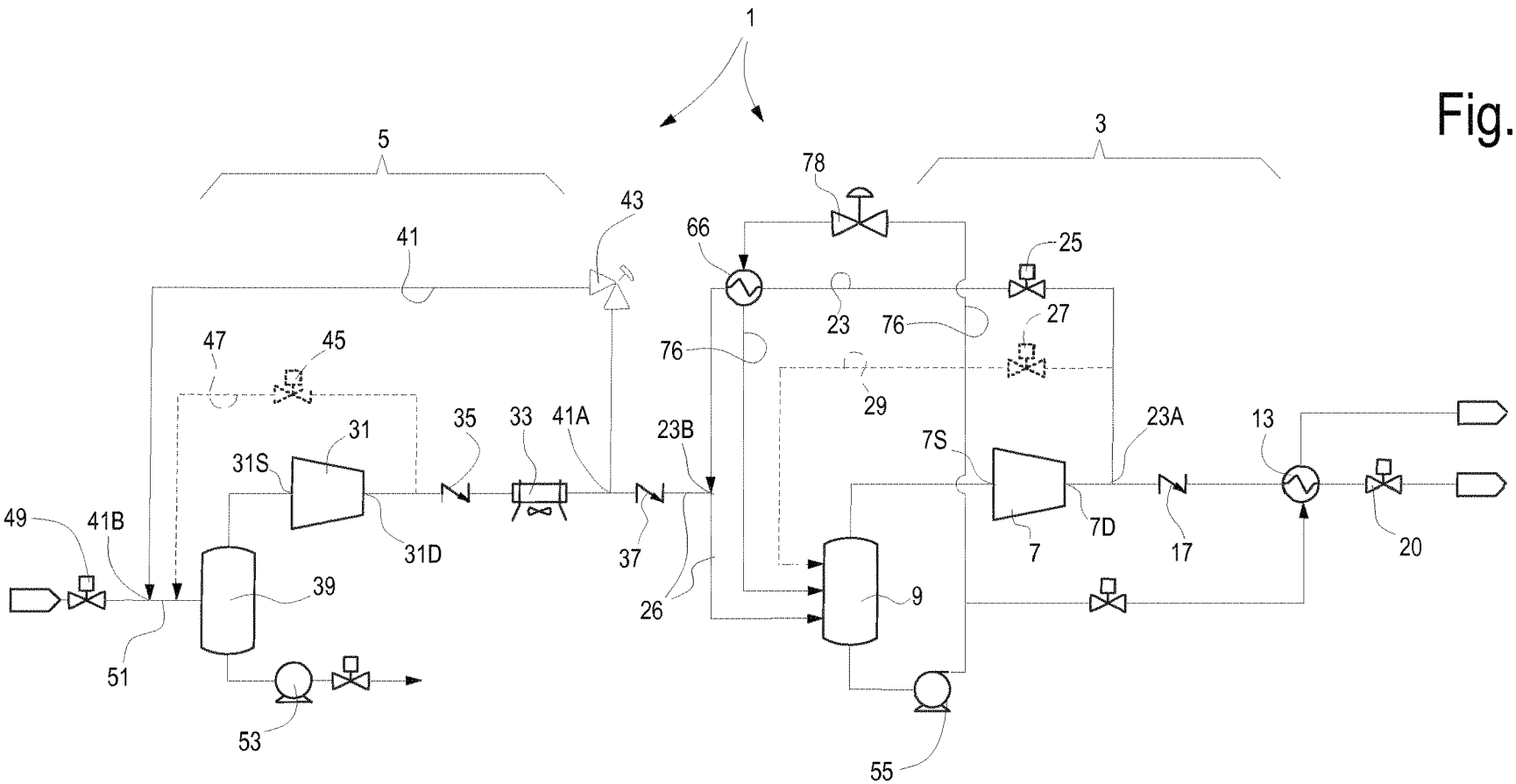
FIG. 4 illustrates a schematic of a compressor system according to an embodiment.

FIG. 4 illustrates a further embodiment of the compressor system 1. Parts, components and elements corresponding to those already described in connection with FIGS. 1 to 3 are indicated with the same reference numbers and will not be described again.

The second section 5 of the compressor system 1 of FIG. 4 is substantially identical to the section 5 of FIGS. 1, 2 and 3. Conversely, the first section 3 differs from those of the previously described embodiments, as no quench valve 61 is provided. Cooling of the gas returned from the delivery side 7D to the suction side 7S of the first compressor 7 is obtained by means of an anti-surge cooler, which can comprise a heat exchanger 66. In some embodiments, not shown, in the heat exchanger 66 the gas circulating in the anti-surge line 23 is cooled by heat exchange against cooling air or cooling water. In the embodiment of FIG. 4, the gas circulating through the hot side of the heat exchanger 66 is chilled by heat exchange against condensed gas. The condensed gas can be provided by the liquid/gas separator 9, through a pump 55 along a line 76. An expansion valve 78 arranged along the line 76 can expand the condensed gas, causing a reduction of the temperature thereof. Exhaust cooling flow, which can contain partly or totally re-evaporated gas, is returned to the liquid/gas separator or suction drum 9.

Figure 5:
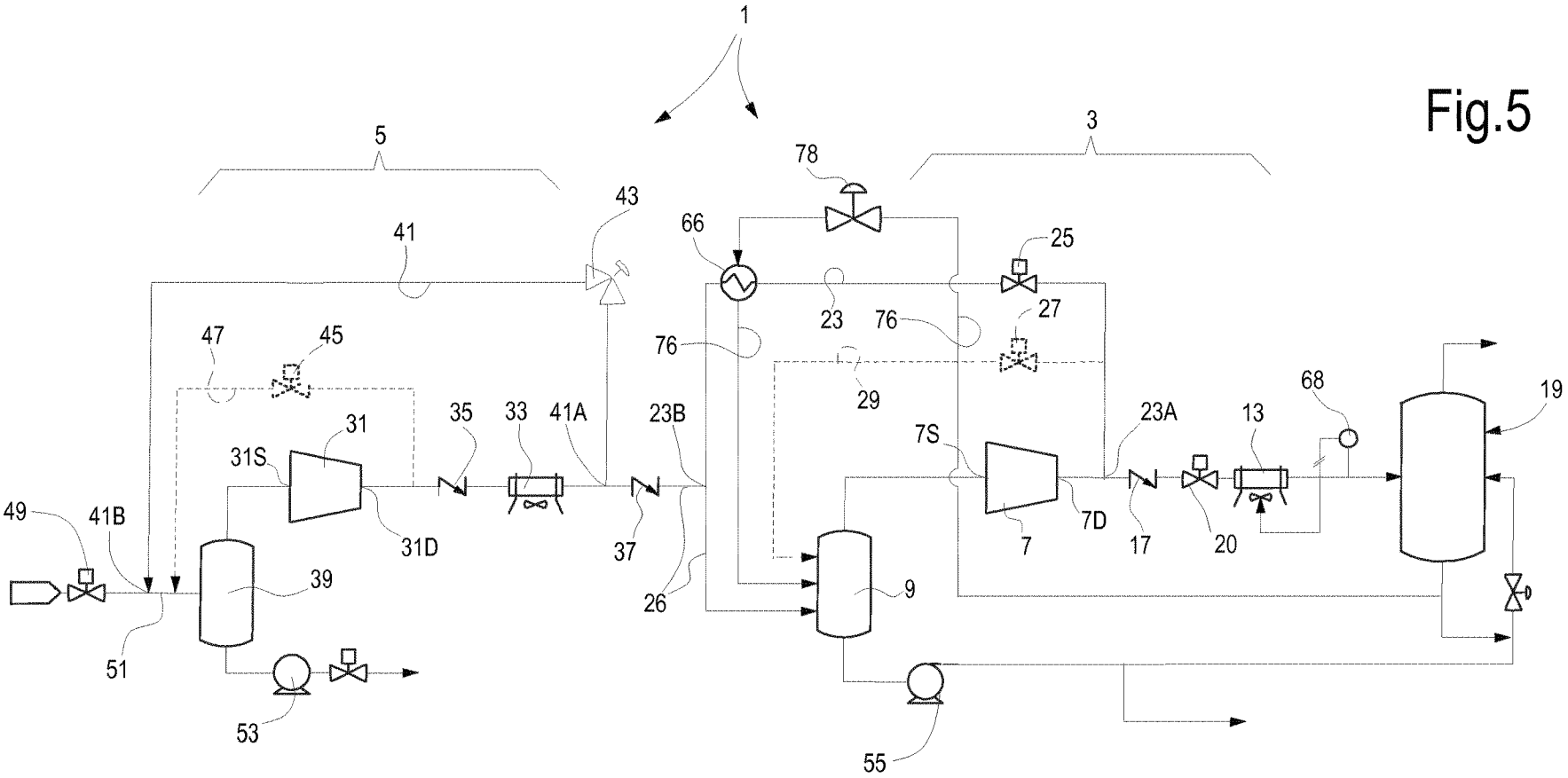
FIG. 5 illustrates a schematic of a compressor system according to an embodiment.

A modified embodiment is shown in FIG. 5. The same reference numbers indicate the same components, parts and elements as in FIG. 4. The embodiment of FIG. 5 differs from the embodiment of FIG. 4, since the condensed gas used to remove heat from the gas circulating in the anti-surge line 23 by heat exchange in heat exchanger 66 is taken from the liquid/gas separator 19.

In further embodiments, a cooling system for cooling the gas flowing in the second anti-surge line 41 of the second section 5 can be provided. The cooling system of the anti-surge line 41 of section 5 can be configured and controlled in a way similar to the cooling system described in connection with the first section 3, according to any one of the above described embodiments.

Figure 6:
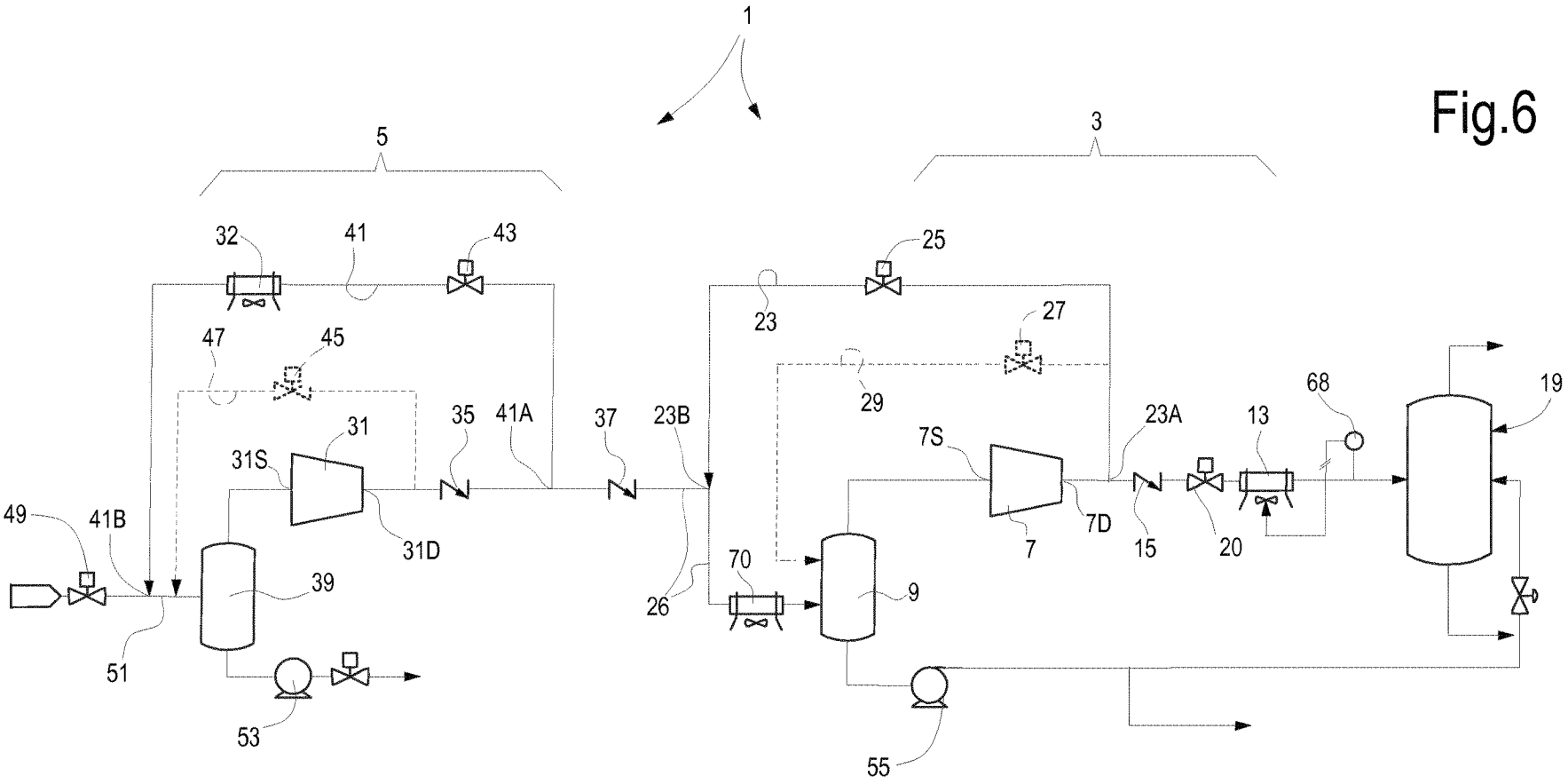
FIG. 6 illustrates a schematic of a compressor system according to an embodiment.

A further embodiment of the compressor system 1, with a cooling system on the second anti-surge line 41 is shown in FIG. 6. Parts, components and elements corresponding to those already described in connection with FIGS. 1 to 3 are indicated with the same reference number and will not be described again.

The second section 5 of the compressor system 1 of FIG. 6 differs from the previously described embodiments, in that the third gas cooler 33 is not provided along the gas feeding line 26. Conversely, a gas cooler 32 is arranged along the second anti-surge line 41, which removes heat from the gas flowing through the second anti-surge line 41, downstream of the second anti-surge valve 43.

In section 3, cooling of the gas returned from the delivery side 7D to the suction side 7S of the compressor 7 is obtained by means of an anti-surge cooler, which can comprise a heat exchanger 70. Differently from the embodiments shown in FIGS. 4 and 5, where a heat exchanger 66 of the anti-surge cooler is located between the first anti-surge valve 25 and the outlet 23B of the first anti-surge line 23, the heat exchanger 70 is located along the gas feeding line 26, between the outlet 23B of the first anti-surge line 23 and the suction drum 9. The heat exchanger 70 can exchange heat against any cooling medium, e.g. air or water, or else condensed and expanded gas.

Through the heat exchanger 70 a total gas flow is processed, which is formed by the gas flow from the second section 5 and by the gas flow possibly recirculating through the first anti-surge line 23. Thus, the heat exchanger 70 performs also the function of the heat exchanger 33 of FIGS. 4 and 5.

While in the embodiments described so far condensed gas is taken from either one or the other of the liquid/gas separators 9 and 19, which function as condensed gas reservoirs, in other embodiments additional or different reservoirs, tanks or containers of condensed gas can be provided, wherefrom condensed gas can be taken for delivery to the quench valve 61 or to the heat exchanger 66.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising", when used in this specification and in the appended claims, specify the presence of the stated features, integers, steps, operations, elements and/or components, but do not preclude the presence or addition of one or more other features, integers, steps, operations, elements, components and/or groups thereof.

While the invention has been described in connection with examples, it is to be understood that the invention is not to be limited to the disclosed examples, but on the contrary, is intended to cover various modifications and equivalent arrangements included within the spirit and scope of the appended claims.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A compressor system comprising:

at least a first compressor having a suction side and a delivery side;

an anti-surge line comprising an anti-surge line inlet and an anti-surge line outlet;

a gas feeding line extending from the anti-surge line outlet toward the suction side of the first compressor;

an anti-surge valve arranged along the anti-surge line between the anti-surge line inlet and the anti-surge line outlet and controlled for recirculating a gas flow from the delivery side to the suction side of the first compressor; and a heat removal arrangement arranged between the anti-surge valve and the suction side of the first compressor, the heat removal arrangement comprising:

an anti-surge cooler comprised of a heat exchanger arranged along the anti-surge line downstream of the anti-surge valve and upstream of the gas feeding line and in heat exchange relationship with a cooling medium to remove heat from gas flowing from the anti-surge valve to the first compressor; and a quench valve, which is fluidly coupled to a reservoir containing a condensed gas separated from the gas processed by the first compressor and delivered at the quench valve at a pressure higher than a gas pressure at the suction side of the first compressor, wherein the quench valve is further fluidly coupled between the anti-surge valve and the suction side of the first compressor and is arranged and controlled for spraying a flow of said condensed gas in a gas stream flowing through the anti-surge line.

2. The compressor system of claim 1, wherein the cooling medium is condensed gas processed by said first compressor.

3. The compressor system of claim 2, wherein a cold side of the heat exchanger of said anti-surge cooler is fluidly coupled to a condensed gas container and to the suction side of the first compressor.

4. The compressor system of claim 3, wherein the condensed gas container forms part of a liquid/gas separator arranged upstream of the first compressor or downstream of the first compressor.

5. The compressor system of claim 1, further comprising a second compressor, arranged upstream of the first compressor, and provided with a respective suction side and a respective delivery side, and with a second anti-surge line, wherein a second anti-surge valve is arranged along the second anti-surge line and is controlled for recirculating a gas flow from the delivery side of the second compressor to the suction side of the second compressor.

6. The compressor system of claim 5, wherein the heat removal arrangement comprises a heat exchanger arranged between the second compressor and the first compressor, fluidly coupled to the delivery side of the second compressor and the suction side of the first compressor.

7. A natural gas liquefaction plant, comprising a natural gas duct in heat exchange relationship with a refrigerant circuit, arranged and configured for removing heat from natural gas flowing in the natural gas duct; wherein the refrigerant circuit comprises a compressor system according to claim 1.

* * * * *